US005791877A

United States Patent [19]

Stenneler

[11] Patent Number: 5,791,877

[45] Date of Patent: Aug. 11, 1998

[54] DAMPING DISPOSITION FOR ROTOR VANES

[75] Inventor: Jacques Stenneler, Le Chatelet en Brie, France

[73] Assignee: Societe Nationale d'Etude et de Construction de Moteurs D'Aviation "Snecma", Paris, France

[21] Appl. No.: 714,976

[22] Filed: Sep. 17, 1996

[30] Foreign Application Priority Data

Sep. 21, 1995 [FR] France ..... 95 11080

[51] Int. Cl.[6] ..... B63H 1/20

[52] U.S. Cl. ..... 416/221; 416/204 A; 416/248; 416/500; 416/219 R

[58] Field of Search ..... 416/204 A, 219 R, 416/220 R, 221, 248, 500

[56] References Cited

U.S. PATENT DOCUMENTS

| | | | |
|---|---|---|---|
| 3,119,595 | 1/1964 | Wilson, III et al. | 416/248 |
| 3,640,640 | 2/1972 | Palfreyman et al. | 416/219 R |
| 3,784,320 | 1/1974 | Rossmann et al. | 411/219 R |
| 4,019,832 | 4/1977 | Salemme et al. | 416/219 R |
| 4,247,257 | 1/1981 | Benoist et al. | 416/221 |
| 4,417,854 | 11/1983 | Cain et al. | 416/221 |
| 4,655,687 | 4/1987 | Atkinson | 416/221 |
| 4,790,723 | 12/1988 | Wilson et al. | 416/220 R |
| 5,160,243 | 11/1992 | Herzner et al. | 416/220 R |
| 5,205,713 | 4/1993 | Szpunar et al. . | |
| 5,240,375 | 8/1993 | Wayte | 416/219 R |

FOREIGN PATENT DOCUMENTS

| | | |
|---|---|---|
| 0 089 272 | 9/1983 | European Pat. Off. . |
| 2 669 686 | 5/1992 | France . |

*Primary Examiner*—Thomas E. Denion

*Attorney, Agent, or Firm*—Oblon, Spivak, McClelland, Maier & Neustadt, P.C.

[57] ABSTRACT

Damping disposition for vanes (3) fitted with stilts (4, 5) engaged in the alveoles of the rotor disk (1). Damping elements (10) are added including a portion (11, 12) extending along the flanks (6) of the stilts (4) and including a portion (15) leaning against them. The beating vibrations of the vanes (3) and dampened by these elements able to be used on smooth vanes without any platform, such as large blower vanes. Application for turbo-engines.

5 Claims, 2 Drawing Sheets

DAMPING DISPOSITION FOR ROTOR VANES

FIELD OF THE INVENTION

The invention concerns a damping disposition for vanes mounted on a rotor disk.

BACKGROUND OF THE INVENTION

One of the major problems to resolve when designing turbo-engines is to reduce as much as possible the vibrations to which the vanes mounted on the rotor are subjected.

A large number of solutions have been put forward, most of these being those put forward in the French patent n°2 619 158. The description of the latter concerns inners disposed between pairs of neighboring vanes under the abutting platforms of these vanes, the general aim being to delimit the gas flow vein. When the rotor rotates, centrifugal force projects the inners against the internal faces of the platforms and more specifically at mid-distance from the vanes as the internal faces of the adjacent platforms lays out an arch. The main effect of the vibrations is to move the platforms laterally which causes the platforms to rub against the inners in which the energy of the vibrations is dissipated.

The French patent n°2 669 686 illustrates another damping system where the space between two vanes is occupied by a damping element composed of two masses on contact of the vanes and a semi-circular leaf spring which connects the masses. The center of the spring is outwardly radially bulged and the masses almost reach the surface of the disk and the foot of the vanes. When the rotor rotates, centrifugal forces push the weights outwardly, which straightens the spring since its center is retained in a support elements linked to the disk and the platforms: the spring therefore moves the weights away from one another and presses them against the vanes, which produces friction damping the vibrations.

This effect is similar to the one obtained with the different device of the invention, but is less easy to exploit as the spring is difficult to suitably dimension: if it is too rigid, the masses do not move away from each other and if it is too flexible, the spring shall warp without sufficiently pushing back the masses. The rubbings of the masses on the vanes shall thus be inadequate in both these cases.

Other defects of this system concern the existence of the support element of the center of the spring which encumbers the disposition, as well as the position of the masses close to the foot of the vanes which only vibrate slightly. The effect of damping is therefore scarcely noticeable, even if the spring functions perfectly.

However, especially for blowers for high-thrust turbo-engines with a high rate of dilution, current methods for producing large vanes, whether they be hollow vanes or composite vanes, mean that the vanes have no platform. The aerodynamic vein between them is then ensured by independent platforms directly integral with the disk. The existing solutions mentioned above to dampen the vibrations of vanes then become inapplicable.

SUMMARY OF THE INVENTION

The object of the invention is to provide a damping disposition for rotor vanes, possibly without any integrated platform. More specifically, the disposition retained includes damping elements fixed to the disk and pressing on the stilts. The geometry of these elements is designed so that the support face of an element of the stilt and the radial plane passing through the center of gravity of the element are disposed on both sides of the radial plane passing through the holding device of the element on the disk.

In these conditions, on rotation, the action of the centrifugal field exerts a torque recalling the element towards the stilt which is expressed by a contact force at the level of the support face of the element on the stilt.

The movements of the stilt induced by the vibrations of the vane then result in causing a relative friction phenomenon ensuring the dissipation of the vibrating energy of the vane.

Several completely different embodiments have been put forward to be described below. Generally speaking, it is possible to adapt the damping elements so as to add to them a platform delimiting the gas flow vein or enable them to carry this platform in the form of a separate element. These platforms replace those integrated with the vanes in traditional conceptions.

BRIEF DESCRIPTION OF THE DRAWINGS

There now follows a non-restrictive description of the invention given by way of illustration with reference to the accompanying figures on which.

DETAILED DESCRIPTION OF THE PREFERRED EMBODIMENTS

Figure 1A:
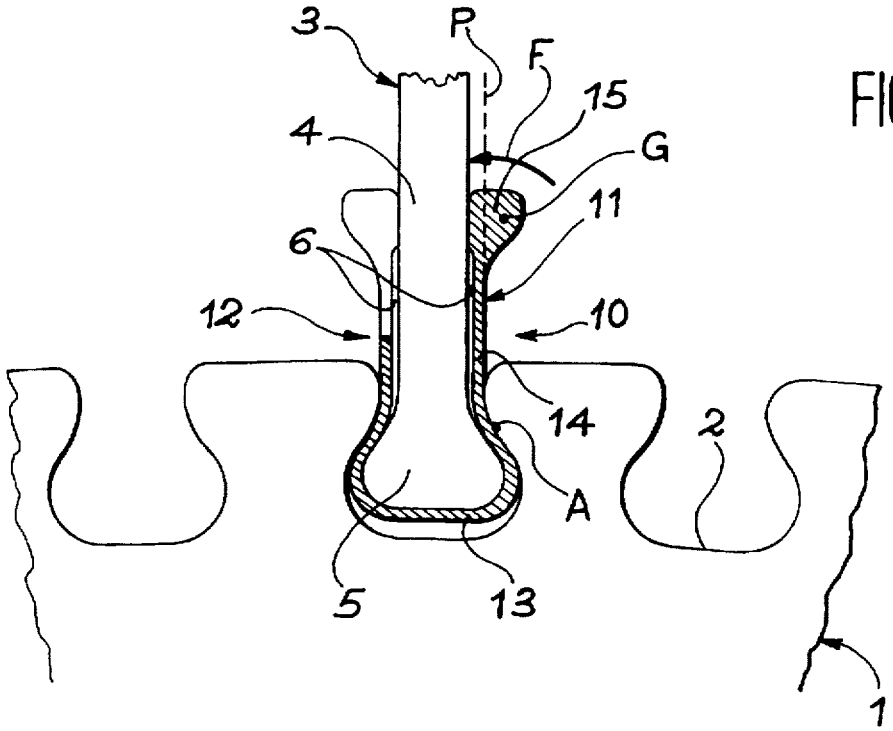
FIG. 1A represents a first embodiment of the invention.

The figures include all appropriate common elements and in particular a rotor disk 1, recessed alveoles 2 parallel to the surface of the disk 1, and vanes 3 partially represented whose lower portion is a stilt 4 ended by a tenon 5 engaged in the alveole 2. As each alveole 2 is contracted around the stilt 4 at the rim of the tenon which is wider, the latter is held captive in the alveole 2.

In a first embodiment of the invention, the damping element 10 forms a sheath around the tenon 5 and the flanks 6 of the stilts 4 against which it is extended by two tongues 11 and 12. When vibrations are produced, the flanks 6 warp in front of the tongues 11 and 12. The intermediate portion 13 of the damping element 19 uniting the tongues 11 and 12 clads the tenon 5 and partly presses onto the surface of the alveole 2. It is thus squeezed between the disk 1 and the tenon 5.

Two similar embodiment variants are shown on the same figure: in the right half, the tongue 11 is continuous along the stilt 4, whereas the tongue 12 of the left half is notched and discontinuous. The damping properties are similar, indeed improved with the discontinuous tongue owing to its weaker rigidity enabling it to be more easily adapt itself to the shape of the curved vanes 3; In all cases, the tongues 11 and 12 include a straight portion 14 extending the intermediate portion 13 upwards and slightly separated from the flank 6, and an upper lip 15 at the extremity of the straight portion 14 with a thickened section and which rests against the flank 6. This upper lip 15 rubs along the flank 6 when the tongue 11 or 12 bearing it warps, which dissipates the energy of the vibrations in heat. The surface of the upper lip 15 needs to be sufficiently smooth or at least produced with precision so as to rest properly on the flank 6, but the rest of the tongue 11 or 12 can be produced more roughly.

As regards details of the behavior of the element 10, first of all it is possible to estimate that the tongue 11 is joined to the disk 1 at a point A situated inside the alveole 2. Now the center of gravity G of the upper lip 15 is separated from the stilt 4 by the plane P parallel to this stilt 4 and passing through the hinge point A. The result is that the centrifugal forces are made to rotate the upper lip 15 in the direction of the arrow F and press it against the stilt 4 which guarantees contact and dampening. It merely requires that the tongue 11 is relatively flexible to allow this rotation. Again in this embodiment of damping elements 10, there are no special means to keep them in place and there is a possibility to exert damping on the more effective portion of the stilt 4 by freely selecting the length of the tongue 11 12: generally speaking, damping ought to be exerted on arches according to the actual vibration modes relatively far from the disk 1.

The same reasoning applies to the tongues 12 and to the other embodiments now to be described.

Figure 1B:
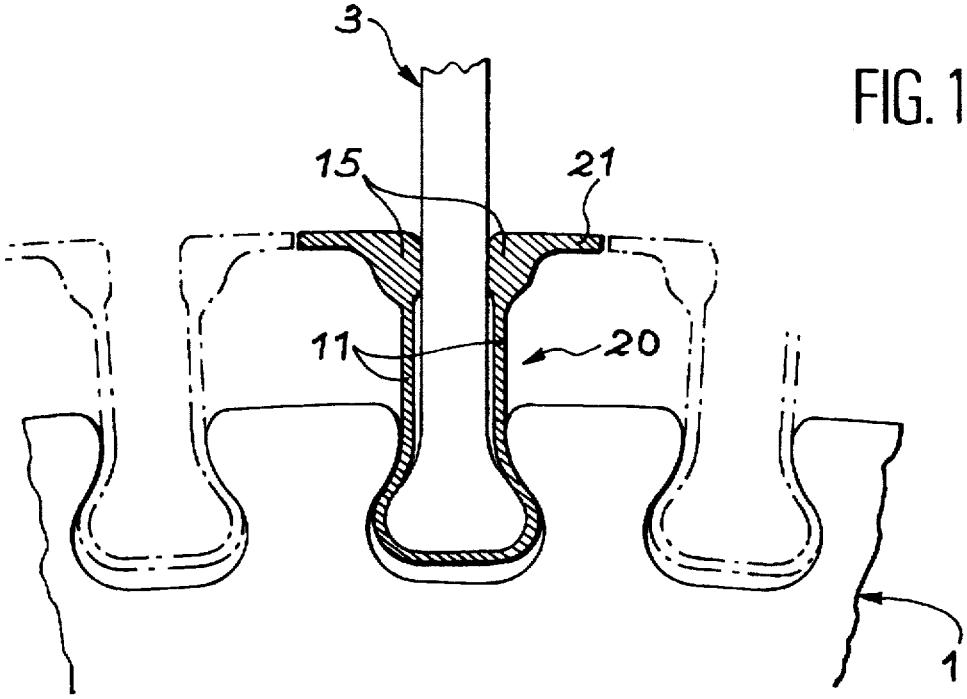
FIG. 1B represents a modification of this embodiment.

FIG. 1B represents an embodiment variant in which the damping element is similar to the element 10 (with continuous tongues 11), except the lips 15 are extended in a direction opposite the vane 3 by a platform a slight distance away from another of the neighboring damping element 20 so as to cover the disk 1 of the rotor as much as possible and delimit the gas flow vein, thus replacing the platforms integrated with other categories of vanes situated at the same location and having the same shape.

The damping elements 10 and 20, like those described hereafter, can be made of metal, such as steel or titanium, so as to resist centrifugal forces.

Figure 2A:
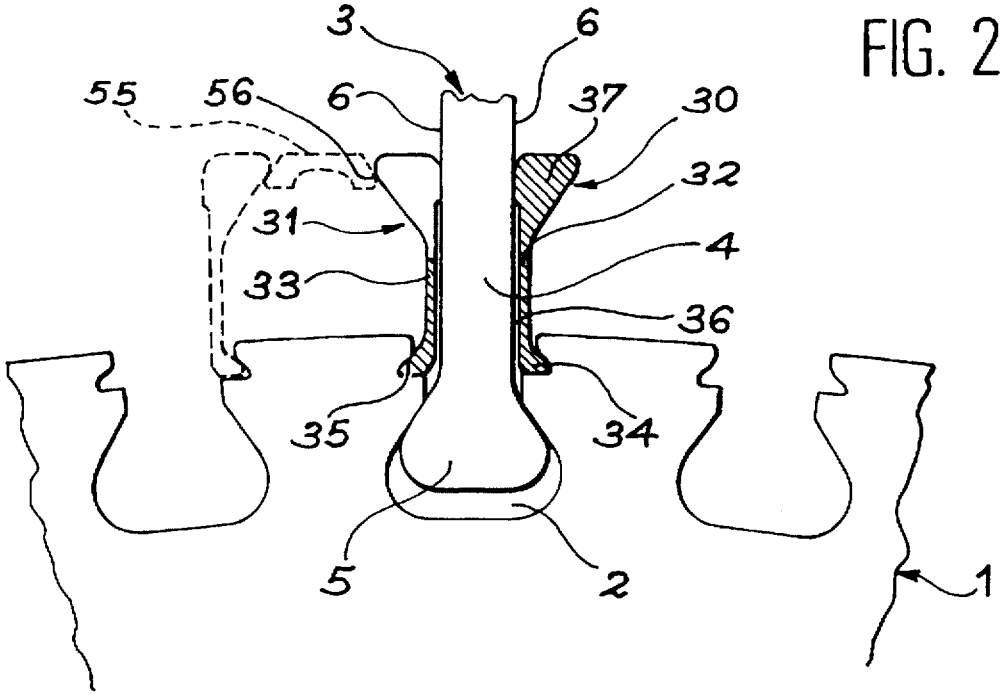
FIG. 2A represents a second embodiment of the invention.

Another embodiment is represented on FIG. 2A where the damping elements only extend onto one of the flanks 6 of the stilt 4. Thus, there are two per vane 3 and, similarly to FIG. 1A, two different types are represented bearing the references 30 (on the right) and 31 (on the left) . In this instance, the tongues also, namely 32 and 33, can be continuous along the flanks 6. In all cases, the intermediate portion 13 is omitted and replaced by an inwardly vent base 34 so as to free it from the stilt 4 and enable it being housed in a groove 35 of the disk 1 adjacent to an alveole 2 and disposed at the rim of the latter on one side of its opening. Here again the entire tongue 32 or 33 does not rest on the flank 6 as the straight portion 36 extending onto the largest portion of the width of the damping element 30 or 31 is separated from the flank 6 by a certain amount of play and only the lip 37 opposite the base 34 dampens the vibrations by rubbing on the flank 6.

The base 34 is retained in the groove 35 by virtue of a nesting which prevents the elements 30 being pulled up from am movement directed outwardly and can be embodied by bending back the base 34 and the groove 35. The hinge point A of FIG. 1A is here situated at the base 34 and the preceding reasoning is again valid as the lip 37 makes the tongue 32 bend under the effect of centrifugal forces so as to rub on the flank 6 of the vane 3.

It is possible to add to this device platform elements 55 between two damping elements 30 or 31. They are retained between the oblique outer faces 56 of the damping elements 30 and 312 and are therefore unable to escape outwardly when the disk 1 rotates. However, they can reinforce the pressure of the outer lips 37 on the flanks 6.

Figure 2B:
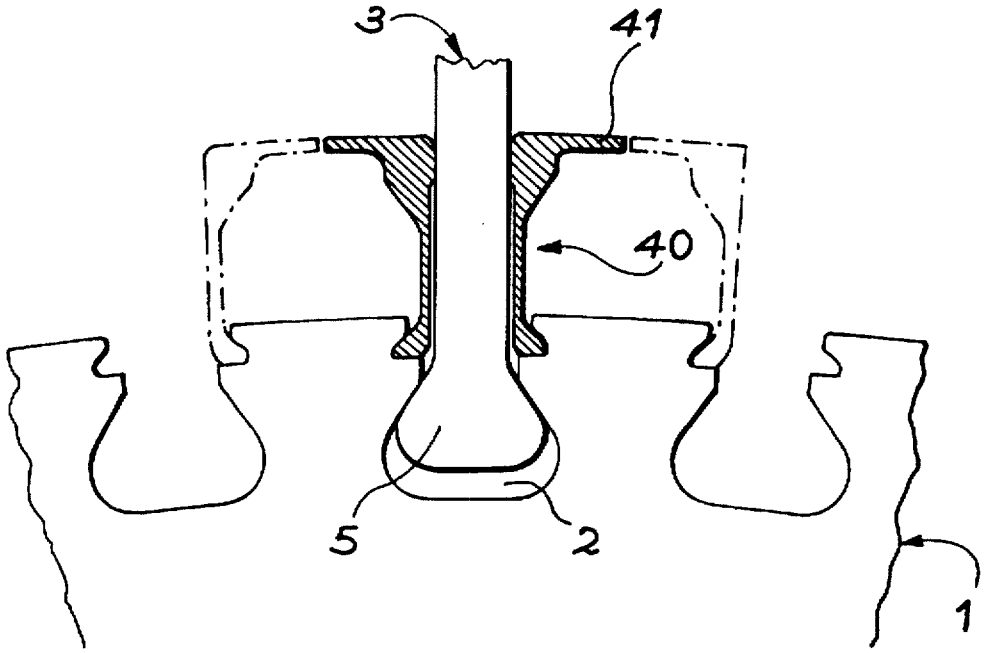
FIG. 2B represents a modification of this embodiment.

FIG. 2B shows a modification (reference 40) of the damping element 30, the latter further including a platform element 41 similar to that (21) of figure 1B and presenting the same advantages for channeling the gases. But as the damping elements 40 are basically the same as the elements 30, it is not necessary to describe them in detail.

The nesting joints by which the damping elements are retained in the embodiments of FIGS. 2A and 2B are not the only ones able to be embodied. An advantageous holding device implies the use of a hinge or other mechanical linking elements, such as screws.

The modified damping elements could receive shape modifications so as to ensure that the moment of rotation applied to them by the centrifugal forces still presses their friction surface against the flank 6 of the vane 3 despite the transformation of their link to the disk 1.

The tongues 11, 12, 32 and 33 could rest on the stilts 4 like the outer lips 15 and 37.

What is claimed is:

1. A damping element for a vane having a blade portion protruding out of a rotor disk and a root portion engaged in an alveole of the disk, said damping element comprising:

an attachment portion clamped between a flank of the alveole and the root portion;

a lip portion having a rubbing surface resting against a flank of the blade portion; and a flexible tongue portion linking the lip portion and the attachment portion, and separated from the blade.

2. A damping element according to claim 1, wherein the tongue portion is straight and the lip portion has a center of gravity which is separated from the tongue portion by a virtual plane parallel to the tongue portion and intersecting a hinge point of the damping element on the attachment portion, the tongue portion flexing around the hinge point.

3. A damping element according to claim 1, comprising two of said tongue portions and two of said lip portions, the tongue portions and lip portions extending on two opposite flanks of the blade portion of the vane, the attachment portion linking both tongue portions together and surrounding the vane root portion.

4. A damping element according to claim 1, wherein the attachment portion comprises an edge retained in a groove on the disk.

5. A damping element according to claim 1, wherein the lip portion is integral with a platform portion covering part of the disk.

* * * * *